United States Patent [19]

Khoury

[11] 4,008,825

[45] Feb. 22, 1977

[54] ABUSE RESISTANT PULL TAB

[75] Inventor: Nick S. Khoury, Worth, Ill.

[73] Assignee: The Continental Group, Inc., New York, N.Y.

[22] Filed: May 10, 1976

[21] Appl. No.: 684,686

[52] U.S. Cl. ..... 220/273

[51] Int. Cl.[2] ..... B65D 41/32

[58] Field of Search ..... 220/269–273, 220/375

[56] References Cited

UNITED STATES PATENTS 3,401,823 9/1968 Fraze ..... 220/273

*Primary Examiner*—George T. Hall

*Attorney, Agent, or Firm*—Paul J. Lerner; Joseph E. Kerwin; John J. Kowalik

[57] ABSTRACT

An improved easy-open end closure pull tab comprising a double folded rivet panel having a lower portion which is carried beyond the outer periphery of the tab ring to form a nose. The panel fold functions as a spring to bias the tab away from the end panel of an end closure after assembly and raises the tab above the end panel so that the tab is springy which increases its abuse resistance. The double folded rivet panel construction allows machining the tab from thin sheet stock.

8 Claims, 3 Drawing Figures

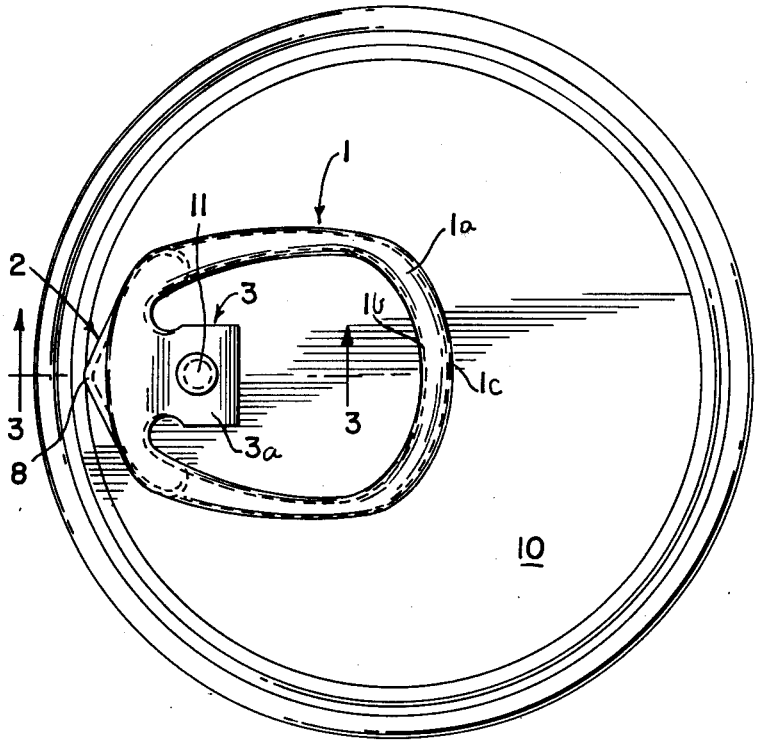
FIG. 1
FIG. 2
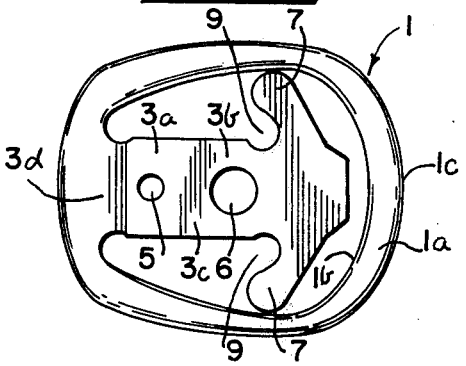
FIG. 3
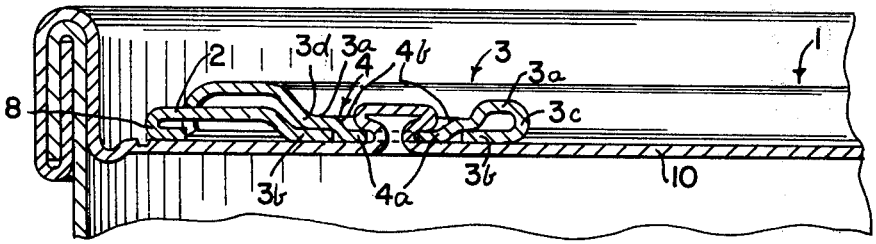

ABUSE RESISTANT PULL TAB

SUMMARY OF THE INVENTION

The present invention relates to a new and useful improvement in an easy-opening container and, more particularly, to a pull tab having improved abuse resistance and reduced metal requirement.

Easy-opening containers of the general type to which the present invention relates include an end panel formed with a score line to define a removable panel portion and a pull tab adapted for tilting movement so that a fracturing member on one end of the tab initially ruptures the score line. Thereafter, a pulling force is applied to the pull tab to complete the severance of the removable panel portion from the container.

It is a primary object of the present invention to provide a pull tab having improved abuse resistance. This is accomplished by utilizing an attachment member which biases a portion of the tab against the end panel to prevent rotation and to maintain the fracturing member in proper alignment with the score line. Biasing further serves to prevent protrusion of the grasping portion of the tab, thus eliminating the possibility of an accidental impact on the protruding tab resulting in an unintentional rupture of the score line.

It is another object of the present invention to provide a pull tab using a reduced amount of metal. This is accomplished by forming the tab attachment member as a double folded panel from material which was displaced to provide the opening in the grasping portion of the tab and was formerly treated as scrap thereby permitting the utilization of thinner gauge material without loss of strength.

With the above and other objects in view that will hereinafter appear, the nature of the invention will be more clearly understood by reference to the following specifications when viewed in light of the accompanying drawing, in which:

FIG. 1 is a top plan view of the pull tab of the present invention.

FIG. 2 is a top plan view of a blank for forming the improved pull tab of the present invention.

FIG. 3 is a cross-section view taken substantially along line 3—3 of FIG. 1.

DESCRIPTION OF THE PREFERRED EMBODIMENT

As shown in the drawings, the pull tab of the present invention comprises a substantially trapezoidal grasping portion 1, an integrally formed fracturing member 2 projecting beyond the outer periphery of the grasping portion 1 and an attachment lug 3 integrally formed on the inner periphery of the grasping portion 1 adjacent the fracturing member 2.

As best illustrated in FIG. 1, the grasping portion 1 includes a substantially planar top web 1*a* and inner and outer panelwardly directed curls 1*b* and 1*c* depending therefrom. The curls 1*b* and 1*c* serve to rigidify the grasping portion 1 and protect the user's fingers.

The attachment lug 3 comprises upper and lower panel portions 3*a* and 3*b* connected by an integral resilient hinge portion 3*c*, and an integral connecting portion 3*d* connecting the lug 3 to the grasping portion 1. The connecting portion 3*d* is of lesser width than the panel portions 3*a* and 3*b* of the lug 3. This width reduction increases the flexibility of the connection and thereby reduces the force required to lift the tab.

The fracturing member 2 comprises an extension of the distal end of the lower panel portion 3*b* beyond the grasping portion 1 and a panelwardly directed curl 8 formed at the end thereof.

A panelwardly directed rivet well 4 is formed in the upper panel portion 3*a* and includes a substantially flat, horizontal base 4*a* and an upwardly and outwardly sloping sidewall 4*b*. A hole 5 is formed in the well base 4*a* and a second, larger hole 6 is formed in the lower panel portion 3*b* beneath the first hole 5. The well structure 4 extends into the hole 6.

The tab is formed from a thin, flat metal blank as illustrated in FIG. 2. As shown, the attachment lug 3 is composed of material which was displaced to provide the opening in the grasping portion 1 and was formerly treated as scrap. The bulk of this material is now utilized in forming the lug 3.

Two transversely extending wing-shaped extensions 7 are formed on the lower panel portion 3*b* and extend substantially across the aperture of the grasping portion 1 near the widest portion thereof. The extensions 7 are inclined or swept toward the connecting portion 3*d* of the lug 3. Two substantially semi-circular cutouts 9 are formed at the inner junctures of the wings 7 and the panel portion 3*b* and provide an area of reduced width.

During the fabrication process, the lower panel portion 3*b* is folded into position with the wings 7 underlying the section of the grasping portion 1 immediately adjacent the attachment lug 3, and the cutouts 9 aligned with the connecting portion 3*d*.

The wings 7 are crimped to the grasping portion 1 by the curls 1*b* and 1*c*, with the distal end of the lower panel portion 3*b* projecting through a break in the outer curl 1*c*. Thus, both the attachment lug 3 and the adjacent section of the grasping portion 1 are formed of double thickness of material. This doubling provides the desired strength and rigidity while allowing the use of thinner gauge material. It is to be noted however, that the reduced width segment of the lower panel portion 3*b* underlies the reduced width connecting portion 3*d*, whereby the connection between the grasping portion 1 and the attachment lug 3 is flexible and serves as a hinge.

As mentioned before, the hinge 3*c* is resilient. During the staking operation wherein the tab is attached to an end panel 10 by a rivet 11 passing through the holes 5 and 6, the hinge 3*c* is loaded with a bending stress. This stressing of the resilient hinge 3*c* causes the tab to be biased against the end panel 10 to inhibit tab rotation and protrusion.

I claim:

1. An improved thin sheet metal pull tab having fracturing means adapted for fracturing a score line of an end closure, grasping means adapted for grasping and lifting of said pull tab, and attachment means integral with said fracturing means and said grasping means, said attachment means comprising a first panel member and a reinforcing panel member, said first panel member being adapted for attaching said pull tab to the end panel of an end closure, said reinforcing panel member being integrally formed in said pull tab and disposed in backing relation to said first panel member to strengthen and rigidify the same, said grasping means comprising an aperture-defining edge member and said reinforcing panel member being formed of material displaced to form the aperture.

2. The invention of claim 1, wherein said reinforcing panel member is folded under said first panel member, said panel members being integrally connected by a resilient hinge portion, said hinge portion springing said panel members away from each other whereby said tab is biased against the end panel of an end closure upon being riveted thereto.

3. The invention of claim 2, wherein said panel members are provided with aperture-defining edge means disposed in alignment with each other perpendicularly of the tab and providing two apertures superposed with respect to each other, and the edge means on said first panel member projecting downwardly into the aperture of said reinforcing panel.

4. The invention of claim 3, wherein said fracturing means is formed on part of said reinforcing panel and directed away from said grasping means.

5. An improved pull tab for an easy-open end closure comprising a body member having an aperture formed therein to facilitate grasping thereof, a fracturing member at one end of said body member, and attachment means integrally formed on the periphery of said aperture adjacent said fracturing member, said attachment means comprising a pair of panels superposed transversely of the principal plane of the pull tab and a hinge resiliently joining said panels.

6. The invention of claim 5, wherein said fracturing member is part of one of said panels.

7. The invention of claim 5, wherein one of said panels is formed with transversely extending wings, said wings being crimped to said body member.

8. The invention of claim 7, wherein said fracturing member projects beyond the outer periphery of said body member.

* * * * *